US009033454B2

(12) United States Patent
Toya

(10) Patent No.: US 9,033,454 B2
(45) Date of Patent: May 19, 2015

(54) LIQUID DISCHARGE DEVICE AND LIQUID DISCHARGE METHOD

(71) Applicant: Seiko Epson Corporation, Tokyo (JP)

(72) Inventor: Akihiro Toya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/298,300

(22) Filed: Jun. 6, 2014

(65) Prior Publication Data

US 2014/0285566 A1 Sep. 25, 2014

Related U.S. Application Data

(63) Continuation of application No. 13/857,558, filed on Apr. 5, 2013, now Pat. No. 8,777,368.

(30) Foreign Application Priority Data

Apr. 9, 2012 (JP) ..... 2012-088192

(51) Int. Cl.

| | |
|---|---|
| ***B41J 29/393*** | (2006.01) |
| ***B41J 2/165*** | (2006.01) |
| ***B41J 2/045*** | (2006.01) |
| ***B41J 29/12*** | (2006.01) |
| ***B41J 19/20*** | (2006.01) |
| ***B41J 29/377*** | (2006.01) |

(52) U.S. Cl.
CPC ..... *B41J 2/165* (2013.01); *B41J 2/0451* (2013.01); *B41J 2/16579* (2013.01); *B41J 29/12* (2013.01); *B41J 19/20* (2013.01); *B41J 29/377* (2013.01)

(58) Field of Classification Search
CPC ..... B41J 29/12; B41J 29/377; B41J 2/3358; B41J 2/125; B41J 2/114153; B41J 2/2142; B41J 2/16579
See application file for complete search history.

(56) References Cited

U.S. PATENT DOCUMENTS

| | | | | |
|---|---|---|---|---|
| 7,040,732 | B2 | 5/2006 | Dudek | |
| 2001/0022601 | A1* | 9/2001 | Ishii et al. | 347/55 |
| 2011/0211896 | A1 | 9/2011 | Kawaguchi et al. | |

FOREIGN PATENT DOCUMENTS

| | | | |
|---|---|---|---|
| JP | 2011-177945 | A | 9/2011 |

* cited by examiner

*Primary Examiner* — Geoffrey Mruk
(74) *Attorney, Agent, or Firm* — Global IP Counselors, LLP

(57) ABSTRACT

A liquid discharge device includes a head, an optical sensor and an air blowing unit. The head is configured and arranged to record on a medium. The optical sensor is configured and arranged to detect presence or absence of foreign matter. The air blowing unit is configured and arranged to blow air toward the optical sensor for removing the foreign matter.

9 Claims, 9 Drawing Sheets

LIQUID DISCHARGE DEVICE AND LIQUID DISCHARGE METHOD

CROSS-REFERENCE TO RELATED APPLICATIONS

This is a continuation application of U.S. patent application Ser. No. 13/857,558, which claims priority to Japanese Patent Application No. 2012-088192 filed on Apr. 9, 2012. The entire disclosures of U.S. patent application Ser. No. 13/857,558 and Japanese Patent Application No. 2012-088192 are hereby incorporated herein by reference.

BACKGROUND

1. Technical Field

The present invention relates to a liquid discharge device and a liquid discharge method.

2. Related Art

As a liquid discharge device, inkjet printers that form images by discharging ink (one type of liquid) from a head are known. As this kind of inkjet printer, items have been proposed with which it is made possible to fetch information relating to image formation by providing an optical sensor constituted by a light emitting unit and a light receiving unit (see Japanese Laid-Open Patent Application Publication No. 2011-117945, for example). Also, for printers that form images by continuously discharging ink from a head while moving a carriage on which a head is installed in a prescribed direction, when this kind of optical sensor is provided at the edge part of the carriage (the prescribed direction edge part), it is possible to detect the presence or absence of foreign matter (paper jams, debris or the like) before the head passes over the medium. Then, when foreign matter is detected, by stopping the movement of the carriage immediately, it is possible to stop the head from colliding with the foreign matter.

SUMMARY

With the kind of printer described above, there are cases when a portion of the ink discharged from the head nozzles floats in a vapor (mist) state without impacting on the medium. Then, it is possible for this mist form ink (ink mist) to adhere to the surface of the optical sensor, and as the ink mist adheres to the surface of the optical sensor, the detection precision of the optical sensor decreases, and there is the risk of misdetection occurring.

In light of that, an object of the present invention is to improve the foreign matter detection precision.

A printing device according to one aspect of the invention includes a head, an optical sensor, and an air blowing unit. The head is configured and arranged to record on a medium. The optical sensor is configured and arranged to detect presence or absence of foreign matter. The air blowing unit is configured and arranged to blow air toward the optical sensor for removing the foreign matter.

Other features of the present invention will become clear from the descriptions in this specification and the attached drawings.

BRIEF DESCRIPTION OF THE DRAWINGS

Referring now to the attached drawings which form a part of this original disclosure:

FIG. 4A is a drawing seen from above, and FIG. 4B is a drawing seen from the front.

DETAILED DESCRIPTION OF EXEMPLARY EMBODIMENTS

At least the following items will become clear from the descriptions in this specification and the attached drawings.

A printing device according to one embodiment includes a head, an optical sensor, and an air blowing unit. The head is configured and arranged to record on a medium. The optical sensor is configured and arranged to detect presence or absence of foreign matter. The air blowing unit is configured and arranged to blow air toward the optical sensor for removing the foreign matter.

According to one embodiment of the printing device, the head is configured and arranged to discharge a liquid onto the medium.

According to one embodiment of the printing device, the optical sensor is configured and arranged to detect a mist from the liquid.

The printing device according to one embodiment further comprises a carriage configured and arranged to move the head, and the air blowing unit includes an outlet port that is provided on the carriage such that the air is blown through the outlet port.

According to one embodiment of the printing device, the optical sensor is disposed on the carriage, and the outlet port is disposed closer to an end of the carriage than a surface of the optical sensor in a predetermined direction.

According to one embodiment of the printing device, the air blowing unit further includes a cylinder that communicates with the outlet port, and the cylinder has a plurality of holes for blowing the air toward the medium.

According to one embodiment of the printing device, the cylinder has a slit formed along a light path of a light of the optical sensor.

The printing device according to one embodiment further comprises a carriage configured and arranged to move the head, the air blowing unit includes a fan that is disposed on the carriage, and configured and arranged to send the air to the outlet port.

A printing method according to one embodiment comprises recording on a medium by a head discharging a liquid onto the medium, detecting presence or absence of foreign matter by an optical sensor, and blowing air toward the optical sensor for removing the foreign matter.

Embodiments

Configuration Example of the Printer

Figure 1:
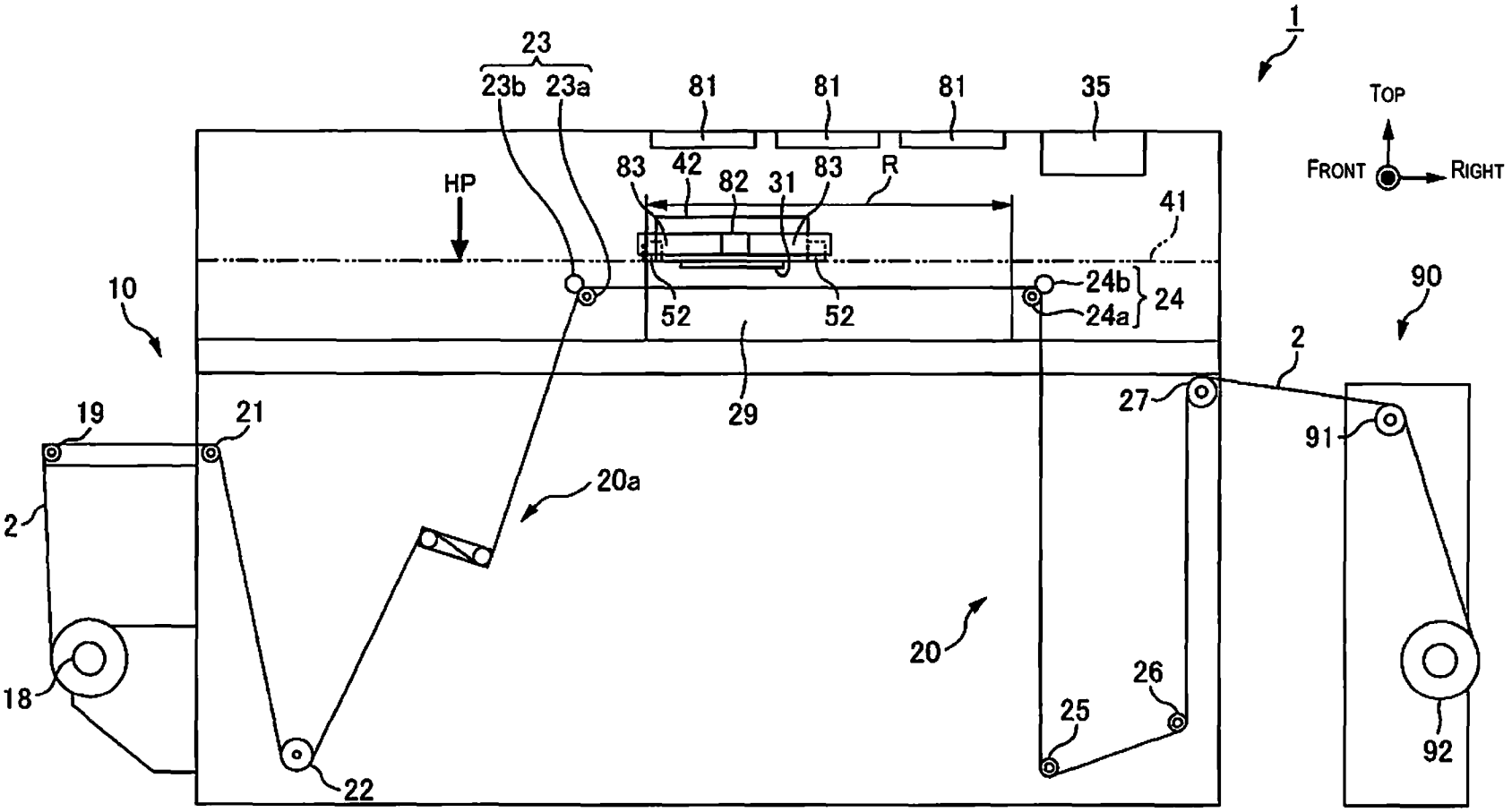
FIG. 1 is a schematic cross section diagram of the printer 1.
Figure 2:
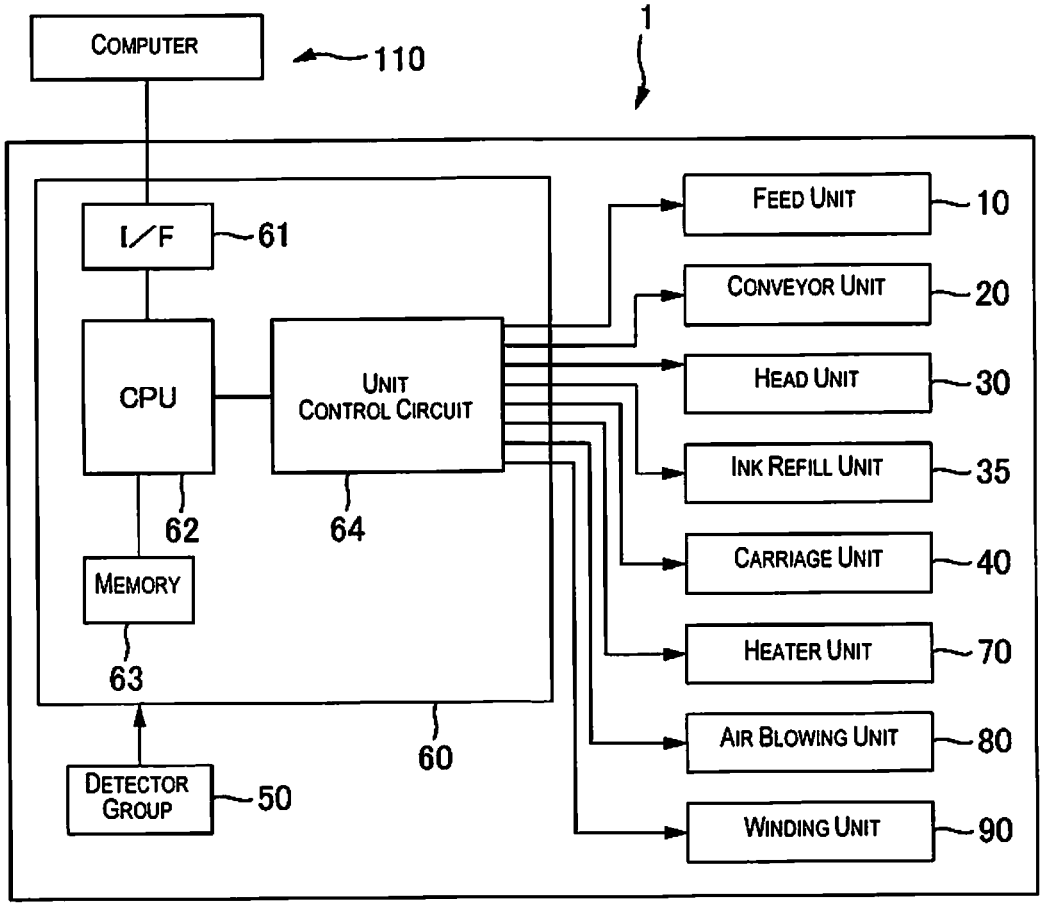
FIG. 2 is a block diagram showing a configuration example of the printer 1.

We will use FIG. 1 and FIG. 2 to describe a configuration example of the printer 1 as an example of the printing device (with this embodiment, an inkjet printer, and particularly, a lateral scan type label printing apparatus). FIG. 1 is a schematic cross section view of the printer 1. FIG. 2 is a block diagram of the printer 1.

With the description below, when using the terms "vertical direction" and "horizontal direction," these indicate items with the directions shown by the arrows in FIG. 1 as the reference. Also, when using the term "front-back direction," this indicates an item with the direction orthogonal to the paper surface in FIG. 1.

Also, with this embodiment, as an example of the medium on which the printer 1 records an image, we will give a description using paper rolled into a roll form (hereafter referred to as roll paper (continuous forms)).

As shown in FIG. 1 and FIG. 2, the printer 1 of this embodiment has a conveyor unit 20, a head unit 30 which has a feed unit 10, a platen 29, and a winding unit 90 along a conveyance path on which the conveyor unit 20 conveys the roll paper 2 (in FIG. 1, represented by the part at which the roll paper 2 is positioned from a roll paper winding shaft 18 up to a roll paper winding drive shaft 92) and furthermore, performs image printing by discharging a plurality of types of ink in a printing area R on the conveyance path, an ink refill unit 35, a carriage unit 40, a heater unit 70 as an example of a heating unit, an air blowing unit 80 that blows air to the roll paper 2 on the platen 29, a controller 60 that controls these units and the like and manages their operation as the printer 1, and a detector group 50.

The feed unit 10 feeds the roll paper 2 to the conveyor unit 20. This feed unit 10 has the roll paper winding shaft 18 on which the roll paper 2 is wound and which is supported to be able to rotate, and a relay roller 19 for winding the roll paper 2 let out from the roll paper winding shaft 18 and leading it the conveyor unit 20.

The conveyor unit 20 conveys the roll paper 2 sent from the feed unit 10 along a preset conveyance path. As shown in FIG. 1, this conveyor unit 20 has a relay roller 21 positioned horizontally to the right in relation to the relay roller 19, a relay roller 22 positioned diagonally downward to the right seen from the relay roller 21, a first conveyor roller 23 positioned diagonally upward to the right seen from the relay roller 22 (upstream side in the conveyance direction seen from the platen 29), a steering unit (navigation unit) 20*a* positioned between the relay roller 22 and the first conveyor roller 23, a second conveyor roller 24 positioned to the right seen from the first conveyor roller 23 (downstream side in the conveyance direction seen from the platen 29), a reverse roller 25 positioned vertically downward seen from the second conveyor roller 24, a relay roller 26 positioned to the right seen from the reverse roller 25, and a delivery roller 27 positioned upward seen from the relay roller 26.

The relay roller 21 is a roller that winds the roll paper 2 sent from the relay roller 19 from the left and slackens it facing downward.

The relay roller 22 is a roller that winds the roll paper 2 sent from the relay roller 21 from the left and conveys it diagonally upward to the right.

The first conveyor roller 23 has a first drive roller 23*a* driven by a motor (not illustrated), and a first driven roller 23*b* arranged so as to sandwich the roll paper 2 and face opposite that first drive roller 23*a*. This first conveyor roller 23 is a roller that pulls the downwardly slackened roll paper 2 upward, and conveys it to the printing area R facing opposite the platen 29. The first conveyor roller 23 temporarily stops conveying during the time that image printing is being implemented on a site of the roll paper 2 on the printing area R. Through drive control by the controller 60, by the first driven roller 23*b* rotating in accordance with the rotational drive of the first drive roller 23*a*, the conveyance volume of the roll paper 2 positioned on the platen 29 is adjusted.

As described above, the conveyor unit 20 has a mechanism that slackens downward the site of the roll paper 2 wound between the relay rollers 21 and 22 and the first conveyor roller 23 and conveys it. This slacking of the roll paper 2 is monitored by the controller 60 based on detection signals from a slack detection sensor (not illustrated). In specific terms, when a site of the roll paper 2 slackened between the relay roller 21 and 22 and the first conveyor roller 23 is detected by the slack detection sensor, a suitable level of tensile force is given to that site, so the conveyor unit 20 is able to convey the roll paper 2 in a slackened state. Meanwhile, when a slackened site of the roll paper 2 is not detected by the slack detection sensor, excessively large tensile force is given to that site, so conveying of the roll paper 2 by the conveyor unit 20 is temporarily stopped, and the tensile force is adjusted to a suitable level.

As shown in FIG. 1, the steering unit 20*a* is positioned on the conveyance path in a tilted state, and is for changing the width direction position of the roll paper 2 (the position at which the roll paper 2 is positioned in the width direction (front-back direction shown in FIG. 1)) by rotating. Specifically, when the roll paper 2 is conveyed along the conveyance path, there are cases when the width direction position of the roll paper 2 is displaced due to things such as axial skew, attachment error or the like of the relay roller or the like, or variation in the tensile strength that acts on the roll paper 2. Then, that steering unit 20*a* is for adjusting that width direction position of the roll paper 2.

The second conveyor roller 24 has a second driver roller 24*a* driven by a motor (not illustrated), and a second driven roller 24*b* arranged so as to sandwich the roll paper 2 and face opposite that second drive roller 24*a*. This second conveyor roller 24 is a roller that conveys a site of the roll paper 2 after the image is recorded by the head unit 30 vertically downward after being conveyed in the horizontally right direction along the support surface of the platen 29. By doing this, the conveyance direction of the roll paper 2 is changed. The second driven roller 24*b* rotates along with the rotational drive of the second drive roller 24*a* by the drive control of the controller 60, and the designated tensile force given to the site of the roll paper 2 positioned on the platen 29 is adjusted.

The reverse roller 25 is a roller that winds the roll paper 2 sent from the second conveyor roller 24 from the upper left side and conveys it diagonally right and upward.

The relay roller 26 is a roller that winds the roll paper 2 sent from the reverse roller 25 from the lower left side and conveys it upward.

The delivery roller 27 winds the roll paper 2 sent from the relay roller 26 from the lower left side and sends it to the winding unit 90.

In this way, the conveyance path for conveying the roll paper 2 is formed by moving the roll paper 2 in sequence via each roller. The roll paper 2 is transported along that conveyance path intermittently in area units corresponding to the printing area R by the conveyor unit 20.

The head unit 30 is for recording an image on the site of the roll paper 2 positioned at the printing area R on the conveyance path. Specifically, the head unit 30 discharges ink from the ink discharge nozzles and forms an image on the site of the roll paper 2 sent by the conveyor unit 20 to the printing area R on the conveyance path (on the platen 29). This head unit 30 has M heads 31.

The head 31 has on its bottom surface (specifically, the nozzle surface) an ink discharge nozzle row in which are aligned discharge nozzles in the row direction (front-back direction). With this embodiment, for each color yellow (Y), magenta (M), cyan (C), black (K), and the like, there is an ink discharge nozzle row consisting of a plurality of ink discharge nozzles #1 to #N. Each ink discharge nozzle #1 to #N of each ink discharge nozzle row is aligned in a straight line in the intersecting direction that intersects with the conveyance direction of the roll paper 2 (in other words, that intersecting direction is the row direction described previously). Each ink discharge nozzle row is arranged in parallel with a gap opened to each other along the applicable conveyance direction.

On each ink discharge nozzle #1 to #N is provided a piezo element (not illustrated) as a drive element for discharging ink drops. When voltage of a designated duration is applied between electrodes provided at both ends, the piezo element expands according to the voltage application time, and deforms that side wall of the ink flow path. By doing this, the volume of the ink flow path contracts according to the expansion of the piezo element, and the ink correlating to this contraction amount becomes ink drops and is discharged from the ink discharge nozzles #1 to #N of each color.

Then, the head unit 30 is formed by having M units of the head 31 aligned in the intersecting direction (the row direction). Because of that, the head unit 30 had M x N ink discharge nozzles for each color.

The ink refill unit 35 is for refilling ink in the head 31 when the volume of ink within the head unit 30 has decreased due to discharging of ink by the head 31.

This ink refill unit 35 is provided for each ink color. Specifically, provided are a yellow ink refill unit for refilling yellow colored ink, a magenta ink refill unit for refilling magenta colored ink, a cyan ink refill unit for refilling cyan colored ink, a black ink refill unit for refilling the black colored ink, and the like.

The ink refill unit 35 is constituted from a large number of tubes that become the ink flow paths (passages) and a large number of valves and the like for opening and closing those tubes. The locations at which those ink cartridges are arranged are expressed by code number 35 in FIG. 1.

The carriage unit 40 is for moving the head unit 30 (head 31). This carriage unit 40 has a carriage guide rail 41 extending in the conveyance direction (horizontal direction) (shown by a double-dot-dashed line in FIG. 1), a carriage 42 supported to be able to move back and forth in the conveyance direction (horizontal direction) along the carriage guide rail 41, and a motor (not illustrated).

The head unit 30 (head 31) is provided on the carriage 42. Then, the carriage 42 is constituted so as to be an integrated unit with the head unit 30 (head 31) and move in the conveyance direction (horizontal direction) by the drive of the motor (not illustrated). Also, when performing cleaning of the head unit 30 (head 31) after image printing, the carriage 42 is an integrated unit with the head unit 30 (head 31) and moved to the upstream side of the conveyance direction along the carriage guide rail 41 (the upstream side of the conveyance direction seen from the platen 29), and stops at the home position at which cleaning is performed (hereafter also called HP) (see FIG. 1).

Also, a flushing unit (not illustrated) is provided between the HP and the platen 29 in the conveyance direction (horizontal direction), and when the head 31 (carriage 42) moves in the conveyance direction (horizontal direction) and is positioned at a position facing opposite the flushing unit, the head 31 executes a flushing operation by which ink is discharged and flushed from each ink discharge nozzle belonging to the ink discharge nozzle row and performs flushing.

The platen 29 is for supporting the site of the roll paper 2 positioned at the printing area R on the conveyance path and heats that site. As shown in FIG. 1, this platen 29 is provided corresponding to the printing area R on the conveyance path, and is arranged at an area along the conveyance path between the first conveyor roller 23 and the second conveyor roller 24. Then, the platen 29 is able to heat that site of the roll paper 2 by receiving supply of the heat generated by the heater unit 70.

The heater unit 70 is for heating the roll paper 2, and has a heater (not illustrated). This heater has nichrome wires, and is constituted such that those nichrome wires are arranged inside the platen 29 so as to be a fixed distance from the support surface of the platen 29. Because of that, with the heater, by being made conductive, the nichrome wires themselves are heated, and it is possible to conduct heat to the site of the roll paper 2 positioned above the support surface of the platen 29. This heater is constituted with nichrome wires built into the entire area of the platen 29, so it is possible to evenly conduct heat to the site of the roll paper 2 on the platen 29. With this embodiment, that site of the roll paper 2 is heated evenly such that the temperature of the site of the roll paper 2 on the platen is 45° C. By doing this, it is possible to dry the ink that has impacted that site of the roll paper 2.

The air blowing unit 80 is for sending air to the roll paper 2 or the like on the platen 29. This air blowing unit 80 is equipped with a fan 81, a fan 82, an air blowing duct 83, and a motor (not illustrated) for rotating each fan. The fan 81 sends air to the roll paper 2 on the platen 29 by rotating, and promotes drying of the ink impacted on the roll paper 2. As shown in FIG. 1, a plurality of fans 81 are provided on a cover (not illustrated) that can open and close and that is provided higher on the main unit part than the carriage 42. Then, when the cover is closed, each of these fans 81 is made to be positioned above the platen 29 and to face opposite the support surface of that platen 29 (the roll paper 2 on that platen 29).

The fan 82 (correlating to the air blowing unit) is provided on the side surface of the carriage 42 as shown in FIG. 1. Then, the fan 82 sends air to the air blowing duct 83 by rotating, and as is described later, prevents adherence of ink mist on the foreign matter detection sensor 52 and promotes drying of the ink impacted on the roll paper 2. Also, the fan 82 is also able to perform cooling of the head unit 30 (head 31).

The air blowing duct 83 is for blowing air generated by the fan 82 to the foreign matter detection sensor 52. A detailed description of the fan 82 and the air blowing duct 83 will be given later.

The winding unit 90 is for winding the roll paper 2 sent by the conveyor unit 20 (the roll paper on which an image is already printed). This winding unit 90 has a relay roller 91 for conveying the roll paper 2 sent from the delivery roller 27 diagonally downward to the right winding from the left side upward, and a roll paper winding drive shaft 92 for winding up the roll paper 2 sent from the relay roller 91 supported to be able to rotate.

The controller 60 is a control unit for performing control of the printer 1. As shown in FIG. 2, this controller 60 has an interface unit 61, a CPU 62, a memory 63, and a unit control circuit 64. The interface unit 61 is for performing data sending and receiving between the computer 110 which is an external device and the printer 1. The CPU 62 is an arithmetic processing device for performing overall control of the printer 1. The memory 63 is for ensuring the area for storing the programs of the CPU 62, a work area and the like. The CPU 62 controls each unit by a unit control circuit 64 according to the programs stored in the memory 63.

The detector group 50 is for monitoring the status within the printer 1, and for example includes the slack detection sensor described above, a rotary encoder attached to the conveyor roller and used for control of conveying of the roll paper 2 and the like, a paper detection sensor for detecting whether or not there is conveyed roll paper 2, a linear encoder for detecting the position in the conveyance direction (horizontal direction) of the carriage 42 (or the head 31), and a paper end position detection sensor for detecting the paper end (edge) position in the width direction of the roller paper 2. Also, the printer 1 of this embodiment is equipped with foreign matter detection sensors 52 (correlating to the optical sensor) as the detector group 50.

Foreign Matter Detection Sensor 52

Figure 3:
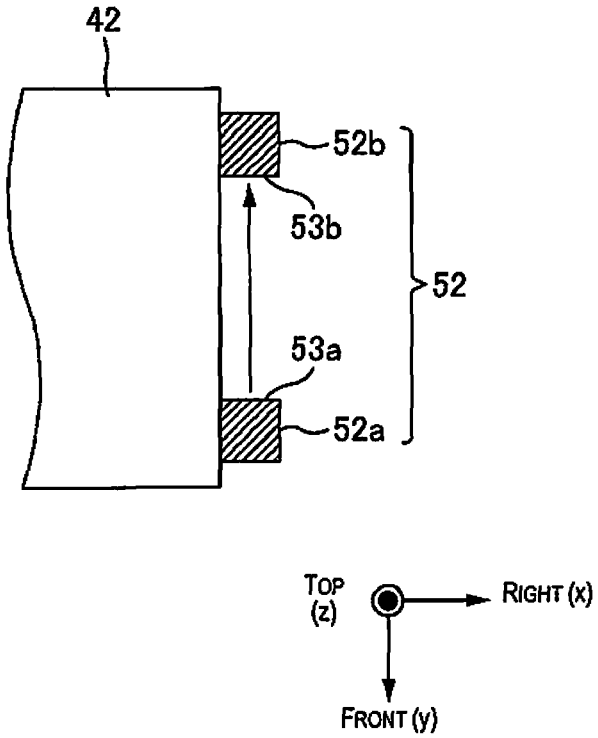
FIG. 3 is a drawing showing a configuration example of the foreign matter detection sensor 52.

FIG. 3 is a drawing showing a configuration example of the foreign matter detection sensor 52. With the descriptions hereafter, for convenience, the "horizontal direction," "front-back direction," and "vertical direction" are also respectively called the x direction, y direction, and z direction. Also, for each direction, the front edge side of the arrow in FIG. 3 is the plus side, and the opposite side is the minus side. For example, the right direction also means the +x direction, and the left direction means the −x direction.

The foreign matter detection sensors 52 are provided on the carriage 42 on the bottom part of both edge surfaces of the direction in which the carriage 42 moves (horizontal (x) direction) (see FIG. 1), and these detect foreign matter (e.g. floating up of the roll paper 2 (paper jam), debris or the like). In FIG. 3, the foreign matter detection sensor 52 provided on the edge surface in the right direction (+x direction) is shown, but the foreign matter detection sensor 52 in the left direction (−x direction) also has the same constitution. As shown in the drawings, the foreign matter detection sensor 52 of this embodiment is constituted having a light projecting side sensor (hereafter also called a light projecting unit) 52*a* and a light receiving side sensor (hereafter also called a light receiving unit) 52*b*.

The light projecting unit 52*a* and the light receiving unit 52*b* are provided on the edge surface of the carriage 42 right direction (+x direction). The light projecting unit 52*a* is arranged at the +y direction edge part on the edge surface, and the −y direction side surface is the lens surface 53*a*. The light receiving unit 52*b* is arranged at the −y direction edge part on the edge surface, and the +y direction side surface becomes the lens surface 53*b*. In this way, the lens surface 53*a* of the light projecting unit 52*a* and the lens surface 53*b* of the light receiving unit 52*b* are respectively projected at opposite facing positions. The lens surfaces 53*a* and 53*b* respectively correlate to the surfaces of the foreign matter detection sensors 52 (light projecting unit 52*a*, light receiving unit 52*b*). In this way, the orientation of the light projecting unit 52*a* surface (lens surface 53*a*) and the light receiving unit 52*b* surface (lens surface 53*b*) are reversed in the y direction.

The light projecting unit 52*a* irradiates laser light from the lens surface 53*a* toward the light receiving unit 52*b*.

The light receiving unit 52*b* receives laser light irradiated from the light projecting unit 52*a* at the lens surface 53*b*.

Then, the foreign matter detection sensor 52 detects the presence or absence of foreign matter according to whether laser light irradiated from the light projecting unit 52*a* was received by the light receiving unit 52*b*. For example, when it is not possible to receive the laser light irradiated from the light projecting unit 52*a* at the light receiving unit 52*b*, then there is something blocking the laser light between the light projecting unit 52*a* and the light receiving unit 52*b*. In this case, the foreign matter detection sensor 52 detects the existence of foreign matter (paper jam, debris or the like) at the carriage 42 movement direction side. When the foreign matter detection sensor 52 detects foreign matter, the controller 60 immediately stops movement of the carriage 42.

However, with the printer 1 like that of this embodiment, there are cases when a portion of the ink discharged from the nozzles of the head 31 float in vapor (mist) form and do not impact on the medium (roll paper 2). In this way, the ink drops that float in vapor form without impacting on the medium (e.g. roll paper 2) have the risk of adhering to any object within the printer 1. For example, it is possible that the ink mist will adhere to each lens surface (53*a*, 53*b*) of the foreign matter detection sensors 52 (light projecting unit 52*a*, light receiving unit 52*b*). When ink mist adheres to each lens surface in this way, the laser light volume decreases, and the foreign matter detection precision decreases. Because of that, there is the risk of foreign matter misdetection.

In light of that, with this embodiment, adherence of ink mist on the lens surfaces 53*a* and 53*b* of the foreign matter detection sensors 52 is prevented. By doing this, the foreign matter detection precision by the foreign matter detection sensors 52 is improved.

Air Blowing Unit of this Embodiment

Figure 4A:
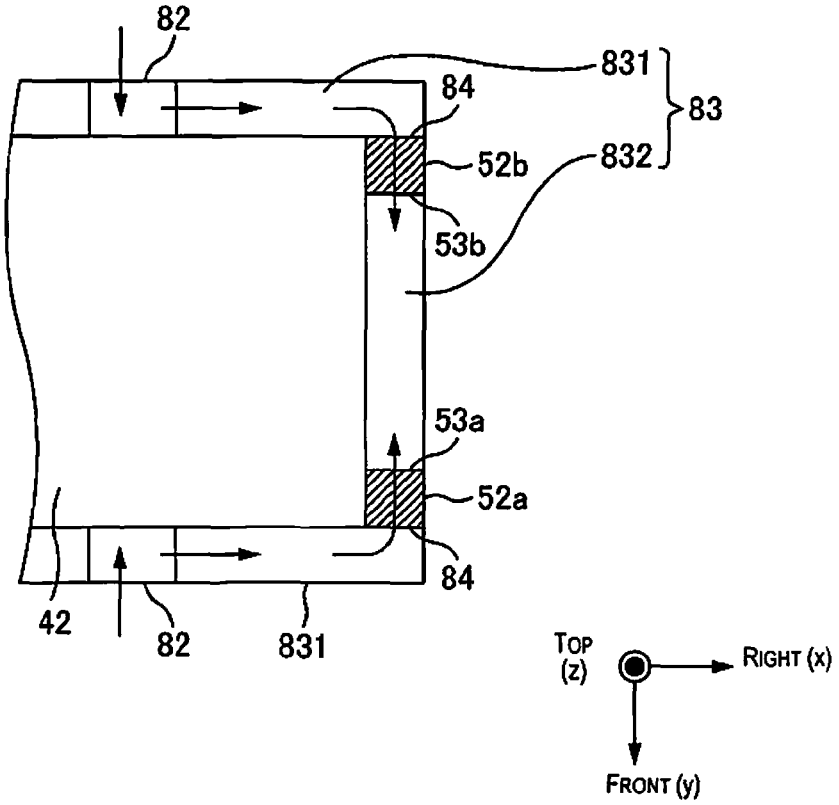
FIG. 4A and FIG. 4B are explanatory drawings showing the constitutional parts of the air blowing unit 80 on the carriage 42 with this embodiment.
Figure 4B:
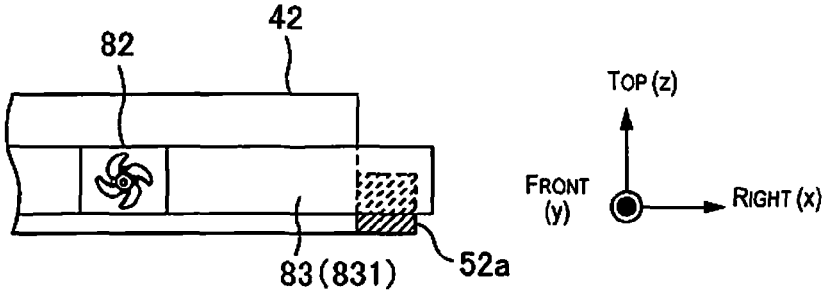

FIG. 4A and FIG. 4B are explanatory drawings showing the constitutional parts of the air blowing unit 80 on the carriage 42 with this embodiment. FIG. 4A is a drawing seen from the upper (+z direction side), and FIG. 4B is a drawing seen from the front (+y direction side). Also, the arrows in FIG. 4A show the direction of the air flow. With this embodiment, the foreign matter detection sensors 52 are provided at both edge surfaces of the carriage 42 x direction, but in the drawing, only the part corresponding to one side of these (+x direction side) is shown. The −x direction side has the same constitution.

The printer 1 of this embodiment has the fan 82 and the air blowing ducts 83 on the carriage 42 as the air blowing unit 80. Also, the air blowing ducts 83 are constituted having ducts 831 and duct 832 (correlating to cylinders).

The fans 82 are provided respectively at both edge surfaces of the +y direction and the −y direction on the carriage 42. The fans 82 are for sending air to the ducts 831 and 832 which take in air from outside of the carriage 42. Also, the fans 82 are able to inhibit a rise in the temperature of the head unit 30 (head 31) by applying air toward the carriage 42 side.

The ducts 831 are rectangular solid shaped cylinder tubes (cylinders) for sending air from the fans 82 to the duct 832. The ducts 831 are respectively provided at both edge surface of the y direction of the carriage 42 so as to correspond to the two fans 82 arranged on the carriage 42. Also, with the two ducts 831, the +x direction edge parts are formed so as to project further than the edge surface of the +x direction of the carriage 42, and the inside of that projecting part (the carriage 42 side in the y direction) are respectively opened to become air outlet ports 84.

The duct 832 is a rectangular solid shaped cylinder tube (cylinder) provided so as to communicate with the outlet ports 84 of the two ducts 831, and are arranged along the y direction at the edge surfaces of the carriage 42 +x direction. In other words, the duct 832 is connected to the ducts 831 via the outlet ports 84. Also, the duct 832 is formed so as to cover other than the bottom part (−x direction side site) of the foreign matter detection sensor 52 (light projecting unit 52*a* and light receiving unit 52*b*).

Figure 5:
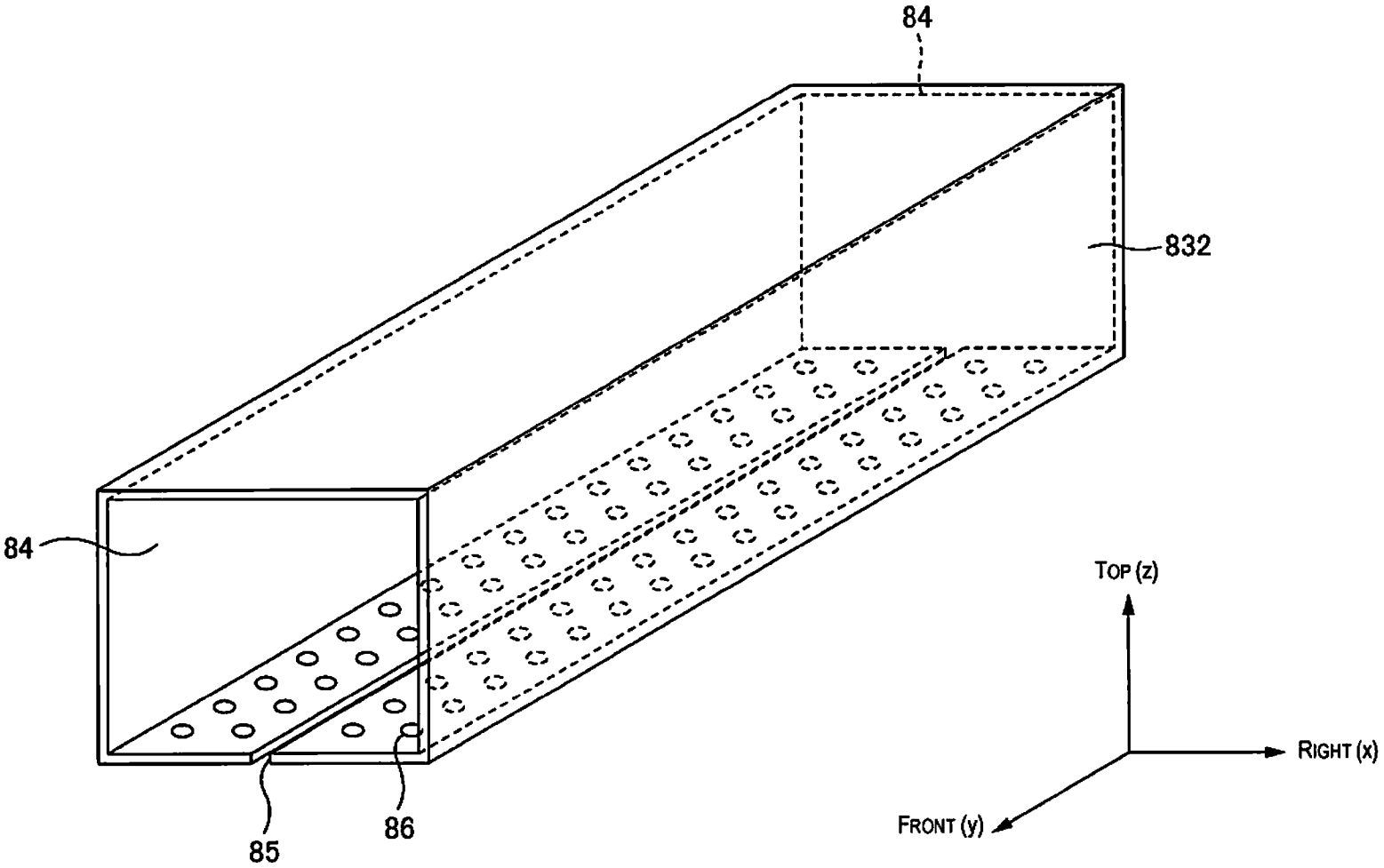
FIG. 5 is a perspective view showing an example of the constitution of the duct 832.

FIG. 5 is a perspective view showing an example of the constitution of the duct 832. In that drawing, illustrations of the light projecting units 52*a* and 52*b* are omitted.

As described previously, the duct 832 is a rectangular solid cylinder tube, and is connected to each duct 831 via the outlet ports 84. Also, a slit 85 and openings 86 are formed on the duct 832 bottom surface (−z direction side surface). The position of the bottom surface of the duct 832 is almost the same position as the position of the light path of the laser light of the foreign matter detection sensor 52. This is because when the bottom surface of the duct 832 is at a position lower than the light path, there is the risk of a collision between that bottom surface and foreign matter before detecting the foreign matter, and conversely, when the bottom surface of the duct 832 is at a position higher than the light path, there is the risk of not being able to prevent adherence of the ink mist to the foreign matter detection sensors 52.

The slit 85 is a gap for the laser light irradiated from the light projecting unit 52*a* to reach the light receiving unit 52*b*, and is formed as a straight line along the y direction on the bottom surface of the duct 832 (in the drawing, roughly the center part of the x direction). With this embodiment, the diameter of the laser light is 1.2 mm, and the slit width is set to be larger than this value (1.2 mm).

The openings 86 are holes provided on the bottom side (−z direction side) for blowing out air sent to inside the duct 832, and a plurality are formed on the bottom surface of the duct 832. After ink from the head 31 is discharged to form an image on the roll paper 2, it is possible to promote drying of the image by blowing out air toward the roll paper 2 from the openings 86 when the carriage 42 is moving. It is also possible to provide a plate member for blocking wind (windbreak plate) under the bottom surface of the duct 832 diagonally in relation to the vertical direction (z direction) so that the air is applied at a position separated from the carriage 42 on the medium (roll paper 2).

Figure 6:
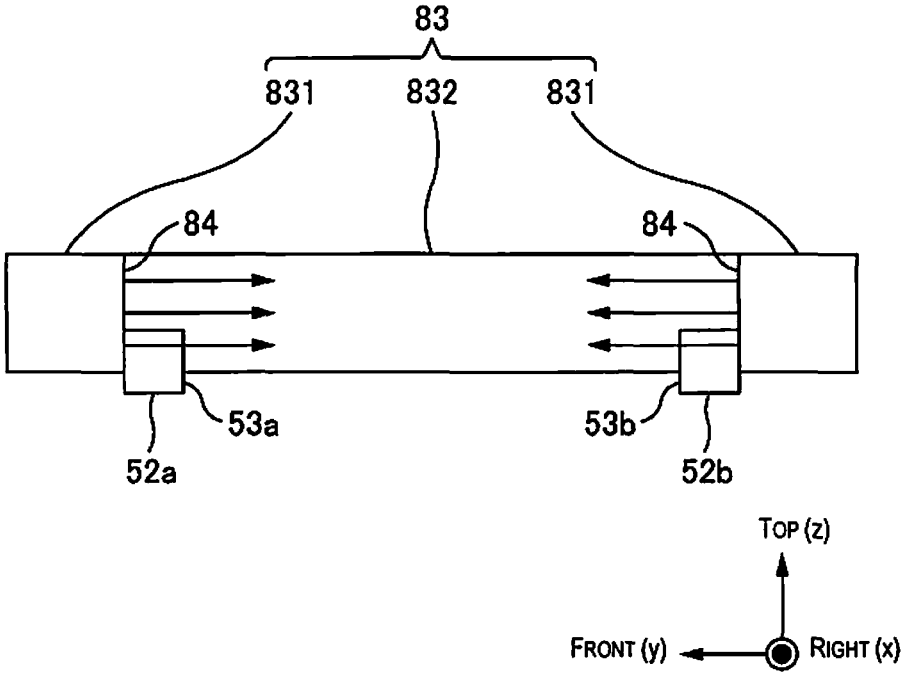
FIG. 6 is an explanatory drawing of the flow of air by the air blowing duct 83 of this embodiment.

FIG. 6 is an explanatory drawing of the flow of air by the air blowing duct 83 of this embodiment. As described previously, the light projecting unit 52*a* surface (lens surface 53*a*) and the light receiving unit 52*b* surface (lens surface 53*b*) orientations are reversed in the y direction.

First, we will describe the left side part of the drawing (the light projecting unit 52*a* side). Here, an air outlet port 84 is provided at the back (+y direction side) on the lens surface 53*a* of the light projecting unit 52*a*.

The air taken into the duct 831 by the fan 82 is sent to the duct 832 from the outlet port 84 formed at the edge of the duct 831. In other words, the air is blown from behind (+y direction side) the lens surface 53*a* of the light projecting unit 52*a* toward the front side (−y direction side) (see the rightward arrow in the drawing). In this way, the air is blown in the direction away from the lens surface 53*a* of the light projecting unit 52*a*, so it is possible to prevent the inflow of ink mist to the light projecting unit 52*a*. Thus, it is possible to prevent the adherence of ink mist on the lens surface 53*a* of the light projecting unit 52*a*.

Next, we will describe the right side part of the drawing (the light receiving unit 52*b* side). Here, an air outlet port 84 is provided at the back (−y direction side) on the lens surface 53*b* of the light receiving unit 52*b*.

The same as with the left side part described previously, here, the air taken into the duct 831 by the fan 82 is sent to the duct 832 from the outlet port 84 formed on the edge of the duct 831. In other words, air is blown from behind (−y direction side) the lens surface 53*b* of the light receiving unit 52*b* toward the front side (+y direction side) (see the leftward arrow in the drawing). In this way, air is blown in a direction separating from the lens surface 53*b* of the light receiving unit 52*b*, so it is possible to prevent the inflow of ink mist to the light receiving unit 52*b*. Thus, it is possible to prevent adherence of the ink mist to the lens surface 53*b* of the light receiving unit 52*b*.

Also, the air sent into the duct 832 from the duct 831 is blown toward the roll paper 2 from the openings 86 on the bottom surface of the duct 832. By doing this, it is possible to promote drying of the image formed on the roll paper 2.

As described above, the printer 1 of this embodiment is equipped with the head 31 for discharging ink, the carriage 42 that moves the head 31 in the horizontal direction (x direction), foreign matter detection sensors 52 (light projecting unit 52*a*, light receiving unit 52*b*) for detecting the presence or absence of foreign matter when the carriage 42 is moved in the x direction, provided at the edge surfaces in the x direction of the carriage 42, and outlet ports 84 provided respectively corresponding to the light projecting unit 52*a* and the light receiving unit 52*b*. Then, air is blown from each outlet port 84 so as to separate from the foreign matter detection sensor 52 surfaces (lens surface 53*a*, lens surface 53*b*). By doing this, it is possible to prevent the adherence of ink mist on the foreign matter detection sensor 52 surfaces (lens surface 53*a*, lens surface 53*b*). By doing this, it is possible to prevent misdetection of foreign matter, and possible to improve the detection precision.

With this embodiment, foreign matter detection sensors 52 are provided on both edges in the movement direction of the carriage 42, but the invention is not limited to this, and it is also possible to provide the foreign matter detection sensor 52 only in one movement direction (for example the forward path direction). In this case as well, it is possible prevent the adherence of ink mist on the foreign matter detection sensor 52, and to improve the foreign matter detection precision.

MODIFICATION EXAMPLE

Figure 7:
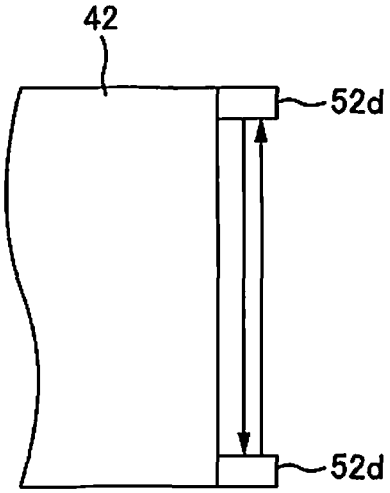
FIG. 7 is a drawing showing a modification example of this embodiment.

FIG. 7 is a drawing showing a modification example separate from this embodiment. In FIG. 7, only the foreign matter detection sensor 52 is shown, and an illustration of the air blowing unit 80 is omitted.

With this modification example, as the foreign matter detection sensors 52, there are retro-reflective type sensor 52*c* and mirror 52*d* (correlating to the reflective plate). The sensor 52*c* irradiates laser light toward the mirror 52*d*. If there is no shielding material between the sensor 52*c* and the mirror 52*d*, the light irradiated from the sensor 52*c* is reflected by the mirror 52*d* and returns to the sensor 52*c*. In this way, with this modification example, the part that performs laser light irradiation and the part that receives light are the same (sensor 52*c*). In this case as well, the same as with the previously described embodiment, it is acceptable to provide the ducts 831 and 832 and the outlet ports 84 so as to blow air from behind the sensor 52*c* and the mirror 52*d* toward the front.

Other Embodiments

We described a printer or the like as an embodiment, but the embodiment noted above is for making the present invention easier to understand, and is not to be interpreted as limiting the present invention. It goes without saying that the present invention can be modified or reformed without straying from its gist, and that equivalent items thereof are included in the present invention. In particular, the embodiments described hereafter are also included in the present invention.

Printer

With the embodiment described previously, we described a printer as an example of the liquid discharge device, but the invention is not limited to this. For example, it is also possible to apply the same technology as this embodiment to various types of liquid discharge device to which inkjet technology is applied, such as a color filter manufacturing device, a dyeing device, a micromachining device, a semiconductor manufacturing device, a surface processing device, a 3D modeling device, a liquid vaporization device, an organic EL manufacturing device (particularly a polymer EL manufacturing device), a display manufacturing device, a film forming device, a DNA chip manufacturing device and the like.

Also, with the previously described embodiment, we described an example of a lateral scan type label printing apparatus as the printing device, but the invention is not limited to this, and for example it is also possible to use a serial scan type large format printer.

Figure 8:
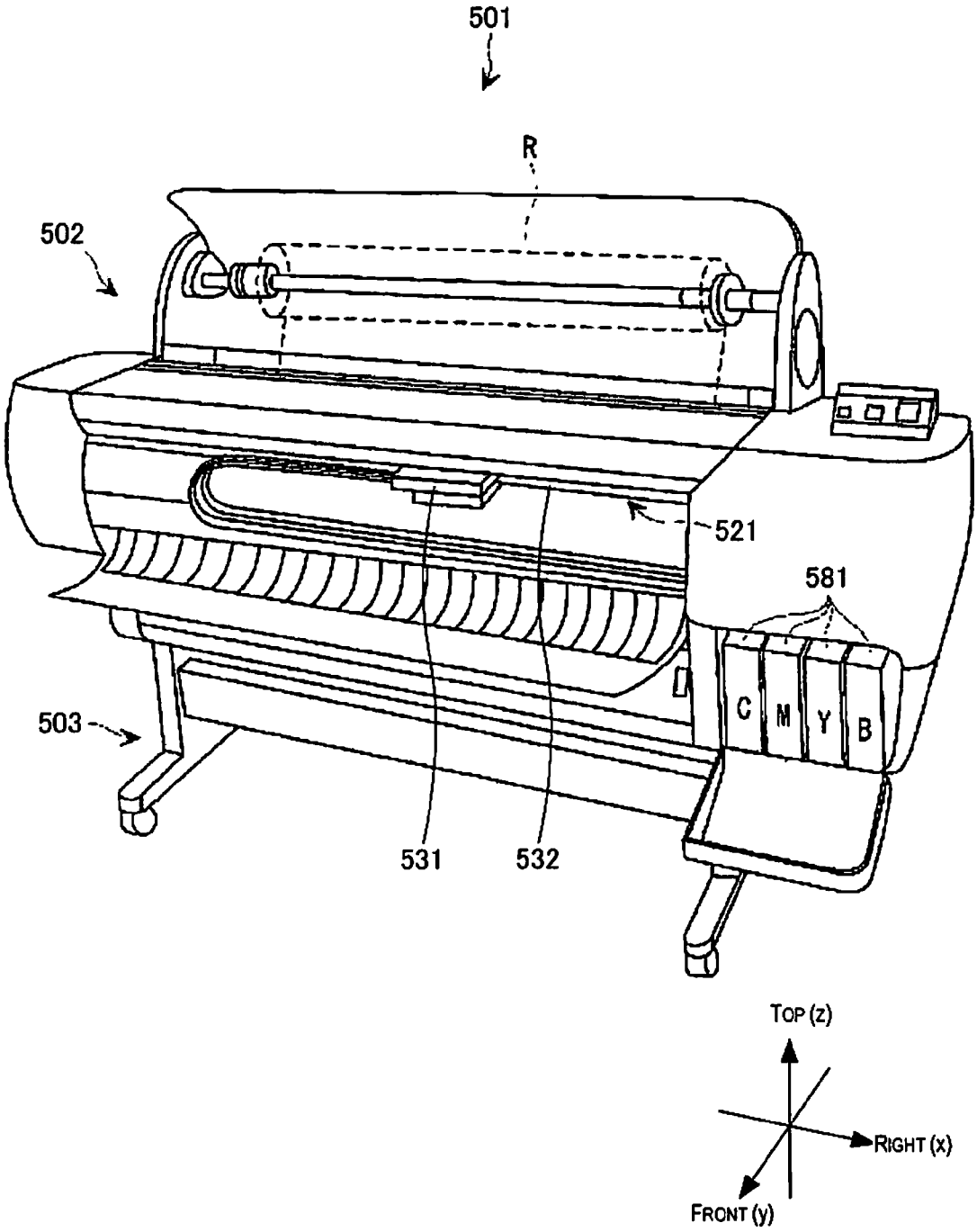
FIG. 8 is an external view pattern diagram of the inkjet printer 501.
Figure 9:
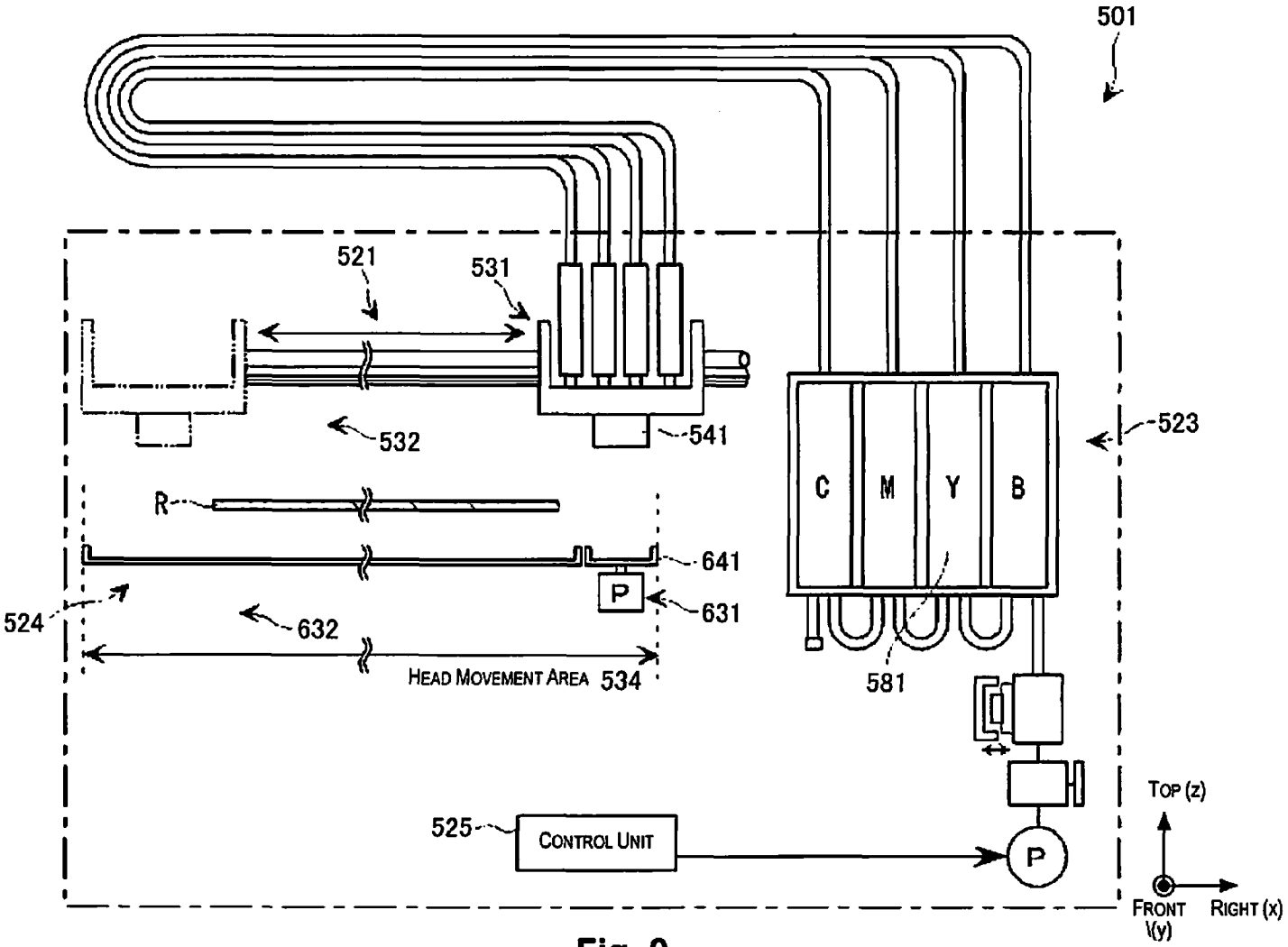
FIG. 9 is a schematic diagram showing the constitution of the inkjet printer 501.
Figure 10:
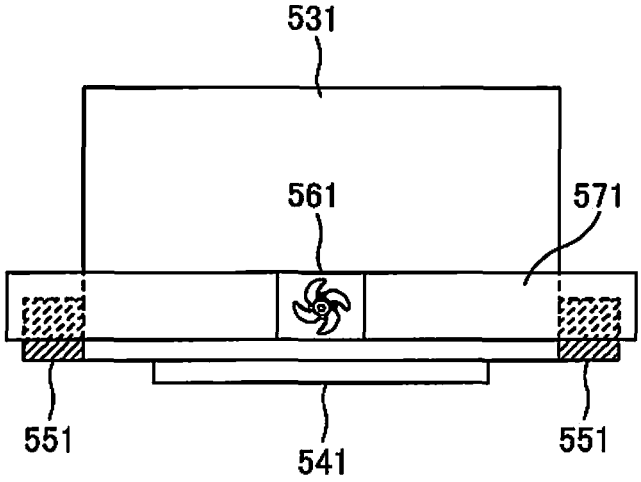
FIG. 10 is a schematic diagram showing the constitution on the carriage 531.

Following, we will describe that serial scan type large format printer (hereafter called the inkjet printer 501) using FIG. 8 through FIG. 10. FIG. 8 is an external view schematic drawing showing the inkjet printer 501. FIG. 9 is a schematic drawing showing the constitution of the inkjet printer 501. FIG. 10 is a schematic drawing showing the constitution of the carriage 531.

The directions are determined as shown by the arrows in each drawing. With the printer 1 of the previously described embodiment, in contrast to the fact that the conveyance direction of the medium (roll paper 2) was the same direction (x direction) as the carriage 42 movement (scan) direction, with this inkjet printer 501, the conveyance direction of the medium (roll paper R) is the y direction, and the carriage movement direction is the x direction.

As shown in FIG. 8 and FIG. 9, the inkjet printer 501 is equipped with a printer main unit 502 having an inkjet head 541 (described later), and a support stand 503 that supports the printer main unit 502. As a basic constitution, this inkjet printer 501 is equipped with a printing means 521 for performing printing on the roll paper R, a feeding means for feeing the roll paper R along the feeding path, an ink supply means 523 for supplying ink to the inkjet head 541 having an ink cartridge 581, a maintenance means 524 provided for maintenance of the inkjet head 541, and a control unit 525 for controlling the overall inkjet printer 501 by controlling these means while associating them with each other. Also, while supplying ink to the inkjet head 541 by the ink supply means 523, by synchronizing the printing means 521 and the feeding means and driving them, an image is printed on the roll paper R. The printing means 521 is equipped with the carriage 531 in which the inkjet head 541 is installed, and a head movement mechanism 532 that supports the carriage 531 to be able to move freely and moves the carriage 531.

The head movement mechanism 532 is constituted so that the carriage 531 moves back and forth inside a preset head movement area 564. With this embodiment, the position hitting against the right side edge in the drawing of the head movement area 564 is set as the home position of the carriage 531, and the movement position of the carriage 531 is understood with this position as a reference position.

The maintenance means 524 is equipped with a suction means 631 for suctioning the inkjet head 541, and a moisture retention means 632 for suppressing drying of the discharge nozzles of the inkjet head 541. The suction means 631 is installed facing the home position, and it is possible to tightly seal the cap 641 on the inkjet head 541 of the carriage 531 facing the home position. Also, the same as with the suction means, the moisture retention means is installed facing the home position, and it is possible to tightly seal the moisture retention cap on the inkjet head 541 of the carriage 531 facing the home position.

The suction means 631 (cap 641) is also used to store the inkjet head 541, and when the inkjet printer 501 is not in operation, the cap 641 is tightly adhered to a nozzle surface 556 of the inkjet head 541, and drying of the discharge nozzles is prevented. Also, by the suction means (cap 641) being constituted such that the cap tight seal part (not illustrated) covers the part at which the cap 641 receives ink, progression of drying of the ink adhered to the cap 641 by suction or the like during the printing operation is prevented.

Also, as shown in FIG. 10, on the carriage 531, the foreign matter detection sensor 551 is provided at the edge surface of the carriage 531 movement direction (in this case, the direction (x direction) intersecting with the conveyance direction (y direction) of the roll paper R). Also, a fan 561 and an air blowing duct 571 are provided on the carriage 531. The constitution and operation of these foreign matter detection sensors 551, fan 561, and air blowing duct 571 are the same as the fan 82, the foreign matter detection sensors 52, and the air blowing duct 83 of the previously described embodiment, so their explanation is omitted.

In this way, by making it such that air is blown from behind the sensor surface of the foreign matter detection sensor 551 on the carriage toward the front with the serial scan type inkjet printer 501 as well, it is possible to prevent adherence of ink mist on the surface of the foreign matter detection sensors 551.

Discharge Method

With the previously described embodiment, ink was discharged using a piezoelectric element (piezo element). However, the method of discharging liquid is not limited to this. For example, it is also possible to use another method such as a method of generating foam within the nozzles using heat.

Ink

With the previously described embodiment, ink was used as the liquid since it was an embodiment of a printer, but the liquid discharged from the nozzles is not limited to being this kind of ink. For example, it is also possible to discharge from the nozzles a liquid including metal material, organic material (particularly polymer materials), magnetic material, electrically conductive material, wiring material, film forming material, electronic ink, machining fluid, a gene solution or the like (including water).

Media

With the previously described embodiment, we described an example of roll paper 2 as the medium, but the invention is not limited to this, and for example it is also possible to use cut paper, film, or cloth.

Head

With the previously described embodiment, the head unit 30 had a plurality (M) of heads 31, but the invention is not limited to this. For example, it is also possible for the head unit 30 to have one head 31.

Foreign Matter Detection Sensor

With the previously described embodiment, the foreign matter detection sensors 52 used laser light when detecting foreign matter, but the invention is not limited to this. For example, this can also be a sensor which uses ultraviolet rays, visible light rays, electromagnetic waves or the like.

Also, with the previously described embodiment, the foreign matter detection sensors 52 were provided on the edge surface of the carriage 42 movement direction (x direction), but the invention is not limited to this. For example, it is also possible to provide notches along the bottom part of the edge surface along the front-back direction (y direction), and to install the foreign matter detection sensors 52 in those notch parts.

Fan

With the previously described embodiment, the fans 82 were provided on the side surface of the carriage 42, but the invention is not limited to this. For example, it is also possible to provide them directly in front of the outlet ports 84, or to provide them on top of the carriage 42. Also, with the previously described embodiment, two fans 82 were provided on the carriage 42, but the invention is not limited to this. For example, it is also possible to provide one fan 82 on the carriage 42, and to provide the air blowing duct 83 so as to blow air on each foreign matter detection sensor 52 by dividing the flow of air generated at that fan 82. It is also possible to provide a fan at a location other than the carriage fan 42. For example, it is also possible to send air sent from the fan 81 provided on the main unit part higher than the carriage 424 to the air blowing duct 83.

It is also possible to provide an intake port to take in air received by the carriage 42 when the carriage 42 moves, and to send air to the air blowing duct 83 from that intake port. However, in this case, supplying a fixed volume of air to the air blowing duct 83 is difficult, and there is the risk that there will be a reduced rate in the prevention of adherence of ink mist to the foreign matter detection sensor 52 or drying of the image formed on the roll paper 2. As with the previously described embodiment, when air is sent from the fan 82 to the air blowing duct 83, it is possible to more reliably prevent adherence of ink mist to the foreign matter detection sensor 52, and furthermore, it is possible to promote drying of the image formed on the roll paper 2.

Air Blowing Duct

With the previously described embodiment, the shape of the air blowing duct (ducts 831, 832) was a rectangular solid (the radial direction cross section is square), but the invention is not limited to this, and it is also possible to have a space for sending air inside. For example, it is also possible for the radial direction cross section to be circular or to be a polygon. Also, similarly, the shape of the outlet port 84 is not limited to being a square, and can also be a circle, or can be a polygon.

Also, when not sending air from the carriage 42 to the medium (roll paper 2), it is possible to not provide the duct 832. In this case as well, air is blown from each outlet port 84 toward the front from behind the surface of the foreign matter detection sensor 52, so it is possible to prevent attachment of the ink mist on the foreign matter detection sensor 52. It is also possible to provide the fan 82 directly in front of the outlet port 84. In this case, it is also possible to not provide the duct 831.

A liquid discharge device according to one embodiment includes a head, a carriage, an optical sensor and an outlet port. The head is configured and arranged to discharge liquid. The carriage is configured and arranged to move the head in a prescribed direction. The optical sensor is provided on the carriage further to an edge part side in the prescribed direction than the head, and configured and arranged to detect presence or absence of foreign matter when the carriage is moving in the prescribed direction. The outlet port is provided on the carriage so that air is blown through the outlet port from behind a surface of the optical sensor toward a front.

With this kind of liquid discharge device, it is possible to prevent attachment of the vapor form liquid to the surface of the optical sensor. By doing this, it is possible to try to improve the foreign matter detection precision.

In the liquid discharge device according to one embodiment, the optical sensor preferably includes a light projecting unit configured and arranged to irradiate light along a direction intersecting the prescribed direction, and a light receiving unit configured and arranged to receive the light irradiated from the light projecting unit. The outlet port is preferably respectively provided corresponding to the light projecting unit and the light receiving unit.

With this kind of liquid discharge device, it is possible to prevent attachment of the vapor form liquid to the surface respectively on the light projecting unit side and the light receiving unit side.

In the liquid discharge device according to one embodiment, the optical sensor is preferably a retro-reflective type sensor, and the liquid discharge device preferably further includes a reflective plate disposed on the edge part side of the carriage, and configured and arranged to reflect the light irradiated from the optical sensor to the optical sensor, and an outlet port corresponding to the reflective plate on the carriage so that air is blown from behind a surface of the reflective plate toward the front.

With this kind of liquid discharge device, it is possible to prevent attachment of mist form liquid to the surface of the reflective plate.

The liquid discharge device according to the embodiment preferably further includes a cylinder through which the opposing outlet ports communicate with each other. The cylinder preferably has a plurality of holes for blowing the air toward a medium.

With this kind of liquid discharge device, it is possible to promote drying of the liquid impacted on the medium.

In the liquid discharge device according to the embodiment, the cylinder preferably has a slit formed along a light path of the light of the optical sensor.

With this kind of liquid discharge device, it is possible to optimize the cylinder arrangement position, and to avoid collision of foreign matter with the cylinder.

The liquid discharge device according to the embodiment preferably further includes a fan disposed on the carriage, and configured and arranged to send the air to the outlet port.

With this kind of liquid discharge device, it is possible to always send a fixed volume of air to the outlet port.

A liquid discharge method according to one embodiment includes: moving a carriage in a prescribed direction; discharging liquid from a head of the carriage; detecting presence or absence of foreign matter using an optical sensor provided on the carriage further to an edge part side in the prescribed direction than the head of the carriage when the carriage is moving in the prescribed direction; and blowing air from behind a surface of the optical sensor toward a front from an outlet port provided on the carriage.

General Interpretation Of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

a head configured and arranged to record on a medium;

an optical sensor configured and arranged to detect presence or absence of foreign matter; and an air blowing unit configured and arranged to blow air toward the optical sensor for removing the foreign matter, the air blowing unit including an outlet port such that the air is blown through the outlet port toward the optical sensor.

2. The printing device according to claim 1, wherein the head is configured and arranged to discharge a liquid onto the medium.

3. The printing device according to claim 2, wherein the optical sensor is configured and arranged to detect a mist from the liquid.

4. The printing device according to claim 1, further comprising a carriage configured and arranged to move the head, wherein the outlet port is provided on the carriage.

5. The printing device according to claim 4, wherein the optical sensor is disposed on the carriage, and the outlet port is disposed closer to an end of the carriage than a surface of the optical sensor in a predetermined direction.

6. The printing device according to claim 4, wherein the air blowing unit further includes a cylinder that communicates with the outlet port, and the cylinder has a plurality of holes for blowing the air toward the medium.

7. The printing device according to claim 6, wherein the cylinder has a slit formed along a light path of a light of the optical sensor.

8. The printing device according to claim 1, further comprises a carriage configured and arranged to move the head, wherein the air blowing unit includes a fan that is disposed on the carriage, and configured and arranged to send the air to the outlet port.

9. A printing method comprising:

recording on a medium by a head discharging a liquid onto the medium;

detecting presence or absence of foreign matter by an optical sensor; and blowing air toward the optical sensor for removing the foreign matter by an air blowing unit, the air blowing unit including an outlet port such that the air is blown through the outlet port toward the optical sensor.

* * * * *